US005408422A

United States Patent [19]

Takatori et al.

[11] Patent Number: 5,408,422

[45] Date of Patent: Apr. 18, 1995

[54] MULTIPLICATION CIRCUIT CAPABLE OF DIRECTLY MULTIPLYING DIGITAL DATA WITH ANALOG DATA

[75] Inventors: Sunao Takatori; Makoto Yamamoto, both of Tokyo, Japan

[73] Assignee: Yozan Inc., Tokyo, Japan

[21] Appl. No.: 162,331

[22] Filed: Dec. 7, 1993

[30] Foreign Application Priority Data

Dec. 8, 1992 [JP] Japan ..... 4-351650

[51] Int. Cl.[6] ..... G06J 1/02; G06G 7/16

[52] U.S. Cl. ..... 364/606; 364/754; 364/841; 327/94; 327/356; 327/552

[58] Field of Search ..... 364/606, 754–760, 364/841–844; 328/160; 307/529

[56] References Cited

U.S. PATENT DOCUMENTS

| | | | |
|---|---|---|---|
| 3,639,847 | 2/1972 | Remy et al. | 328/160 |
| 3,714,462 | 1/1973 | Blackmer | 328/160 |
| 4,422,155 | 12/1983 | Amir et al. | 364/606 |

*Primary Examiner*—Paul P. Gordon
*Assistant Examiner*—Emmanuel L. Moise
*Attorney, Agent, or Firm*—Cushman, Darby & Cushman

[57] ABSTRACT

A new and unique multiplication circuit solves the problems associated with digital multiplication circuits which operate on digital operands only. The multiplication circuit according to the present invention uses negative feedback in conjunction with an operational amplifier to maintain the output voltage of the operational amplifier at a level which depends on the logic level of the digital input datum applied to the gate of a field-effect transistor in the negative feedback loop. This unique multiplication circuit is capable of directly multiplying digital data with analog data.

8 Claims, 4 Drawing Sheets

MC1
MC2
Din
Dout
Dm
Sw
Hout
H11
H12
H13
H14
H15
H16
H17
H18
H21
H22
H23
H24
H25
H26
H27
H28
M11
M12
M13
M14
M15
M16
M17
M18
M21
M22
M23
M24
M25
M26
M27
M28
m11
m12
m13
m14
m15
m16
m17
m18
m21
m22
m23
m24
m25
m26
m27
m28
A11
A12
A13
A14
A15
A16
A17
A21
A22
A23
A24
A25
A26
A27

Din
Hin
H11
H12
H13
H14
H15
H16
H17
M11
M12
M13
M14
M15
M16
M17
M18
m18
m17
m16
m15
m14
m13
m12
m11
m28
m27
m26
m25
m24
m23
m22
m21
At
+
Sw
Hout
Dout
M21
M22
M23
M24
M25
M26
M27
M28
H21
H22
H23
H24
H25
H26
H27
H28

MULTIPLICATION CIRCUIT CAPABLE OF DIRECTLY MULTIPLYING DIGITAL DATA WITH ANALOG DATA

BACKGROUND OF THE INVENTION

Recently, there have been concerns about limitations in the use of digital data processing equipment because of an exponential increase in the required investment in sophisticated digital equipment.

While analog data processing equipment may possess a cost advantage, there is a large volume of data conventionally stored in digital format. Therefore, a more practical solution is to use circuits capable of operating on both digital and analog data, in particular, a multiplier circuit capable of directly multiplying digital data with analog data. However, no such multiplication circuit has been taught previously.

FIELD OF THE INVENTION

The present invention relates to multiplication circuits, and more particularly, to multiplication circuits capable of directly multiplying digital data with analog data.

SUMMARY OF THE INVENTION

More specifically, the present invention solves the problems associated with conventional multipliers operating on digital data by directly multiplying analog data with digital data.

The multiplication circuit according to the present invention uses negative feedback in conjunction with an operational amplifier to maintain the output voltage of the operational amplifier at a level which depends on the logic level of the digital input datum applied to the gate of a field-effect transistor in the negative feedback loop, while applying the input analog signal to the non-inverting input of the operational amplifier.

Furthermore, the multiplication circuit according to the present invention uses a capacitor network to implement an adder capable of adding two or more analog signals.

DESCRIPTION OF THE PREFERRED EMBODIMENTS

Figure 1:
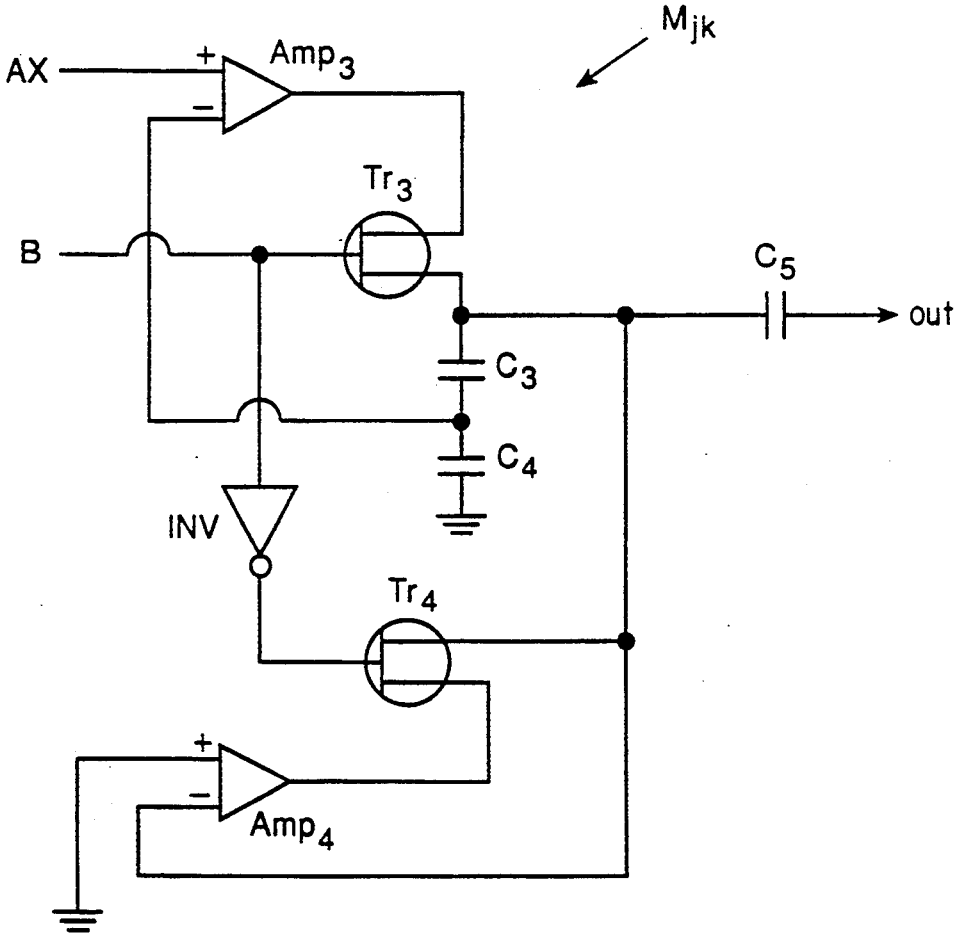
FIG. 1 is a circuit schematic illustrating an embodiment of the multiplication circuit relating to the present invention.

Referring now to the drawings, FIG. 1 illustrates a multiplication circuit M, having a pair of operational amplifiers $Amp_3$ and $Amp_4$, and a pair of switching means such as field-effect transistors $Tr_3$ and $Tr_4$. An analog input AX feeds the non-inverting input of $Amp_3$. The drain and gate of $Tr_3$ are connected to the output of $Amp_3$ and the digital input datum B, respectively. The source of $Tr_3$ has a path to ground through the series connection of capacitors $C_3$ and $C_4$ forming a voltage divider means. The voltage at the junction of $C_3$ and $C_4$ is fed back to the inverting input of $Amp_3$.

$Tr_3$ conducts when the digital input datum B is at a logic high level. The conduction of $Tr_3$ completes the negative feedback path around $Amp_3$, forcing the voltage at the inverting input of $Amp_3$ (the voltage across capacitor $C_4$) to be substantially equal to the input voltage AX. This, in turn, results in the source voltage of $Tr_3$ to be substantially equal to $\{AX\ (C_3-C_4)/C_3\}$.

The non-inverting input of $Amp_4$ is grounded. The output and inverting input of $Amp_4$ are connected to the source and drain of $Tr_4$, respectively. The drain of $Tr_4$ is further connected to the source of $Tr_3$. An inverter INV inverts the digital input datum B, and controls the gate of $Tr_4$ with this inverted signal. Therefore, $Tr_4$ conducts when input B is at a logic low level. The conduction of $Tr_4$ completes the negative feedback loop around $Amp_4$, thus forcing the output voltage of $Amp_4$ to substantially zero volts (ground voltage).

The source of $Tr_3$ and the drain of $Tr_4$ are coupled to an output OUT through capacitor $C_5$. The voltage at OUT is weighted by the capacitance of so that when input B is at a logic high level, the output of the circuit is determined by:

$$\{(c_3-c_4)/C_3\}C_{cp}\,AX,$$

where $C_{cp}$ is a weight determined by capacitive coupling and is a function of the capacitance of $C_5$. Conversely, a logic low level at input B results in an output substantially equal to zero.

Figure 4:
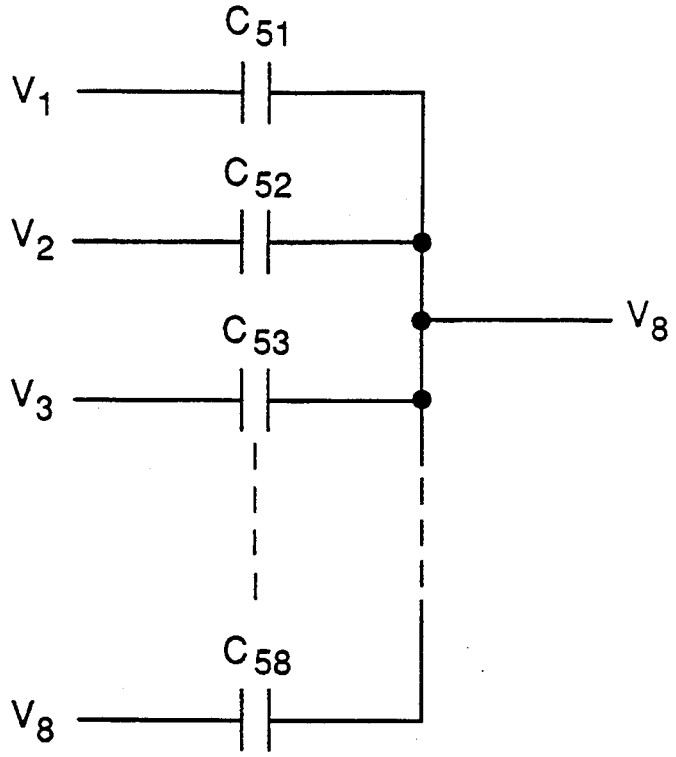
FIG. 4 is a circuit schematic illustrating a capacitor network for adding analog signals, such as the outputs of several multiplication circuits realized according to the present invention.

FIG. 4 is the circuit diagram of a capacitive coupling network including a number of capacitors connected to a common node $V_s$. In the particular implementation illustrated in FIG. 4, there are eight capacitors, $C_{51}$ to $C_{58}$. Input voltages $V_1$ to $V_8$ are applied to capacitors $C_{51}$–$C_{58}$, respectively, resulting in a weighted output voltage $V_8$, defined by:

$$v_8=(C_{51}V_1+C_{52}V_2+\ldots+C_{58}V_8)/(C_1+C_2+\ldots+C_8).$$

By applying each bit of an input digital operand to input B of a plurality of circuits such as that illustrated in FIG. 1, and defining $\{(C_3-C_4)/C_3\}\ C_{cp}$ as $2^n$, where n is the number of bits in the digital operand, direct multiplication of the analog input voltage AX and the digital input quantity is achieved.

Figure 2:
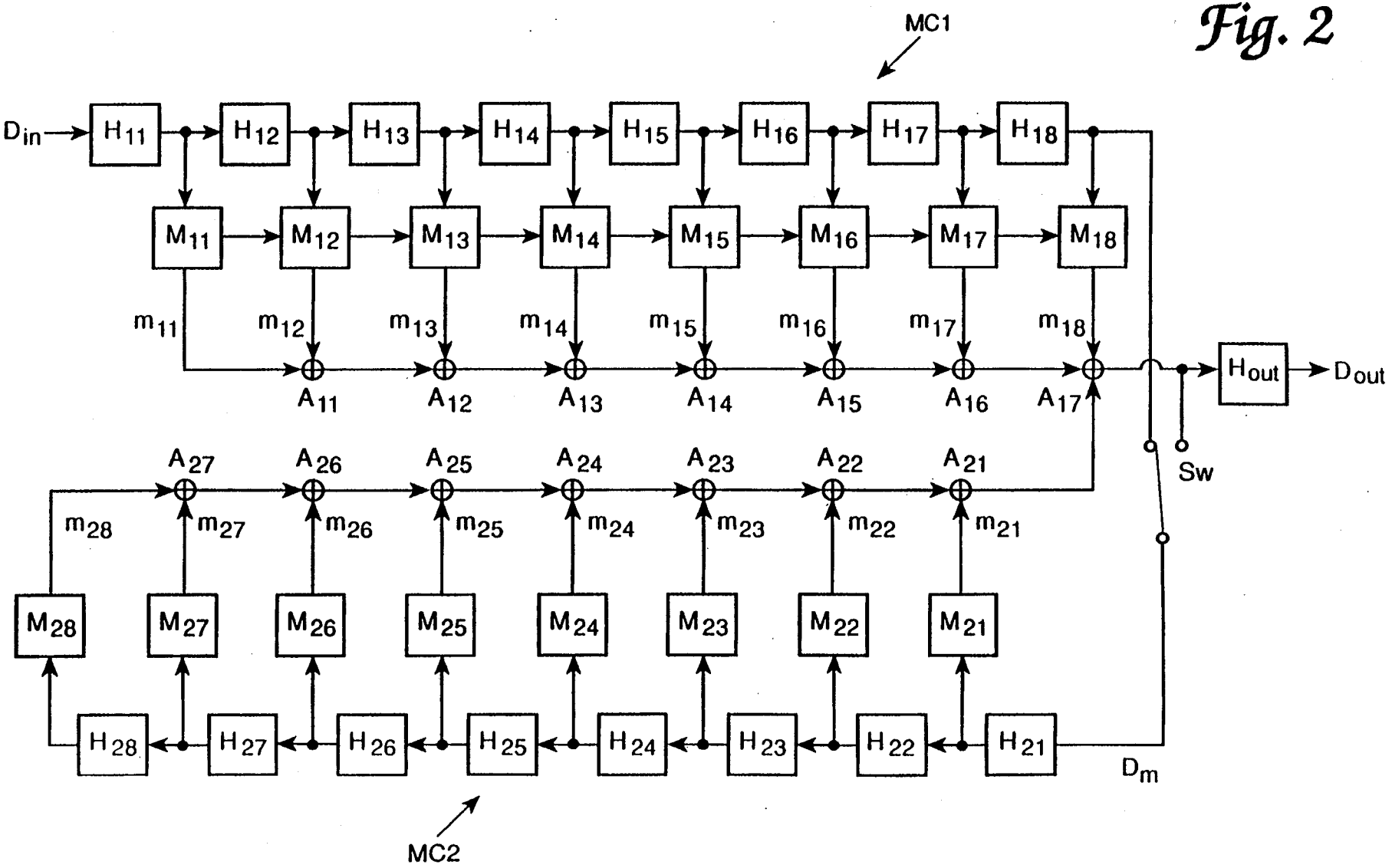
FIG. 2 is a block diagram illustrating the use of the multiplication circuit according to the present invention in a filter circuit with switchable Finite Impulse Response (F.I.R.) and Infinite Impulse Response (I.I.R.) characteristics.

The multiplication circuit described above is suitable for various applications, such as the filter circuit illustrated in FIG. 2. Each of the blocks labeled $M_{11}$ to $M_{18}$ and $M_{21}$ to $M_{28}$ in FIG. 2 is composed of a multiplication circuit such as the circuit illustrated in FIG. 1.

The filter in FIG. 2 has two calculation circuits, MC1 and MC2, respectively, each performing both addition and multiplication. The first calculation circuit, MC1, comprises a number of sample-and-hold circuits, $H_{11}$ to $H_{18}$, connected in tandem. The output of each sample-and-hold circuit $H_{1k}$ is input to a multiplication circuit $M_{1k}$. Similarly, the second calculation circuit, MC2, comprises a number of sample-and-hold circuits, $H_{21}$ to $H_{28}$, connected in tandem. The output of each sample-and-hold circuit $H_{2k}$ is input to a multiplication circuit $M_{2k}$.

An input datum Din is fed to the first sample-and-hold circuit $H_{11}$, and is sequentially transferred to sample-and-hold circuits $H_{12}$ to $H_{18}$ through the application of succeeding clock pulses. This sequential datum is represented by X(t-k). Predetermined quantities $a_1$ to $a_8$ are applied to the remaining inputs of multiplication circuits $M_{11}$ to $M_{18}$ prior to the application of the clock pulses. Thus, the output of each multiplication circuit $M_{1k}$ is given by:

$$m_{1k}=a_k \times X(t-k).$$

The outputs of multiplication circuits $M_{1k}$ and $M_{1(k+1)}$ are added by an adder circuit $A_{1k}$, and the result of the addition is input to the succeeding adder circuit, $A_{1(k+1)}$. Thus, adder circuit $A_{17}$ calculates a sum of the outputs of all the multiplying circuits in calculation circuit MC1, defined by:

$$\sum_{i=1}^{8} a_k \times X(t-k).$$

Depending on the setting of switch SW, either the output of adder $A_{17}$ or the output of sample-and-hold circuit $H_{18}$ is input to the second calculation circuit MC2, and is sequentially transferred to sample-and-hold circuits $H_{21}$ to $H_{28}$ through succeeding clock pulses. This sequential datum is represented by Y(t-k). Predetermined quantities $b_1$ to $b_8$ are applied to the remaining inputs of multiplication circuits $M_{21}$ to $M_{28}$ prior to the application of the clock pulses. Thus, the output of each multiplication circuit $M_{2k}$ is defined by:

$$m_{2k}=b_k \times Y(t-k).$$

The outputs of multiplication circuits $M_{2k}$ and $M_{2(k+1)}$ are added by an adder circuit $A_{2k}$, and the sum is input to the following adder circuit $A_{2(k-1)}$. Thus, adder circuit $A_{27}$ calculates a sum of the outputs of all the multiplication circuits in calculation circuit MC2, defined by:

$$\sum_{i=1}^{8} b_k \times Y(t-k).$$

The output of adder $A_{21}$ is input to adder $A_{17}$ in calculation circuit MC1. Thus, the output of adder $A_{17}$ is the sum of the multiplication results calculated by MC1 and MC2.

The circuit illustrated in FIG. 2 can realize a filter with either F.I.R. or I.I.R. characteristics, depending on the position of switch SW. When switch SW is set so as to connect the output of $H_{18}$ to the input of $H_{21}$, $D_m$ is equal to X(t-8). In this case, the output of calculation circuit MC2 is defined by:

$$\sum_{i=1}^{8} b_k \times X(t-k-8).$$

Expressing $b_k$ as $a_{(k+8)}$, the sum of the outputs of calculation circuits MC1 and MC2 is produced by the output of $A_{17}$, defined by:

$$\sum_{i=1}^{16} a_k \times X(t-k).$$

Thus, the circuit realizes an F.I.R. filter.

Conversely, when switch SW is set so as to connect the output of $A_{17}$ to the input of $H_{21}$, $D_m$ is defined by:

$$D_m = \sum_{i=1}^{8} a_k \times X(t-k) + \sum_{i=1}^{8} b_k \times Y(t-k).$$

In this case, the circuit realizes an I.I.R. filter because Y(t) is equal to $D_m$.

Therefore, a filter circuit which has the characteristics of either an F.I.R. filter or an I.I.R. filter depending on the position of a single switch can be realized by using multiplication circuits according to the present invention.

Using the multiplication circuits described above in conjunction with sample-and-hold circuits, high-speed filters with a relatively large number of stages can be realized for a wide variety of applications.

Figure 3:
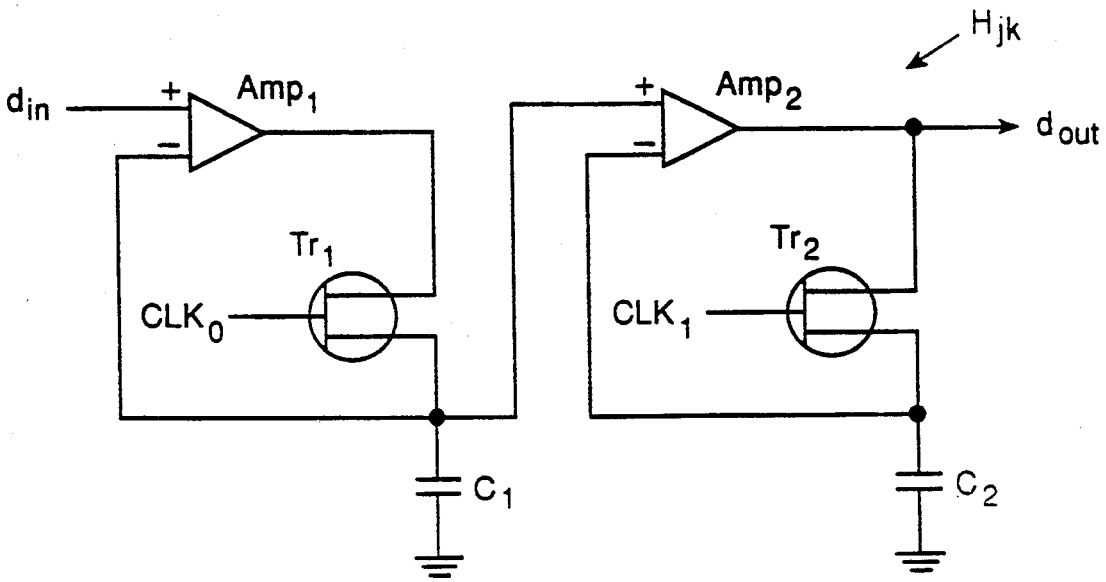
FIG. 3 is a circuit schematic illustrating a sample-and-hold circuit to be used in conjunction with the multiplication circuit according to the present invention in a filter circuit.

FIG. 3 illustrates a sample-and-hold circuit $H_{jk}$, having a pair of operational amplifiers $Amp_1$ and $Amp_2$, and a pair of field-effect transistors $Tr_1$ and $Tr_2$. An input voltage $d_{in}$ is connected to the non-inverting input of $Amp_1$. The output of $Amp_1$ is connected to the drain of $Tr_1$. The source of $Tr_1$ is coupled to ground through a capacitor $C_1$. The source of $Tr_1$ is further connected to the inverting input of $Amp_1$.

A clock source $CLK_0$ drives the gate of $Tr_1$, such that $Tr_1$ conducts when $CLK_0$ is at a logic high level. Thus, a logic high level at the $CLK_0$ input completes the negative feedback path around $Amp_1$, forcing the voltage across $C_1$ to be substantially equal to $d_{in}$.

The network comprising amplifier $Amp_2$, transistor $Tr_2$, and capacitor $C_2$ forms a second stage of the sample-and-hold circuit. The output of $Amp_2$ is connected to the drain of $Tr_2$. The source of $Tr_2$ is coupled to ground through a capacitor $C_2$. The source of $Tr_2$ is further connected to the inverting input of $Amp_2$. A clock source $CLK_1$ drives the gate of $Tr_2$, such that $Tr_2$ conducts when $CLK_1$ is at a logic high level. Clock signals $CLK_0$ and $CLK_1$ are complementary logic signals.

Thus, when $Tr_2$ conducts, the voltage across $C_2$ is substantially equal to the voltage developed across $C_1$ when there was a logic high level present at the $CLK_0$ input. Capacitor $C_2$ stores electric charge until its terminal voltage becomes substantially equal to the input voltage $d_{in}$. Therefore, after a full clock cycle, the output voltage $d_{out}$ is substantially equal to the input voltage $d_{in}$. The timing between clock signals $CLK_0$ and $CLK_1$ ensures that there is no influence on the following stage during the charging of $C_2$.

The adders $A_{jk}$ ($A_{11}$ to $A_{17}$ and $A_{21}$ to $A_{27}$ in FIG. 2) can be realized by a capacitive weighting network, as illustrated in FIG. 4. These adders can be designed so as to have either two or three inputs.

The output signal $D_{out}$ of the filter circuit in FIG. 2 is the output of a sample-and-hold block $H_{out}$.

Figure 6:
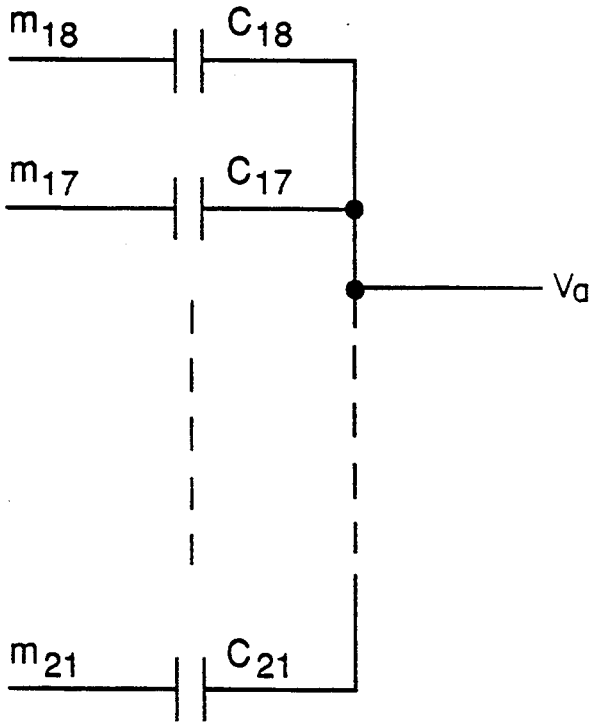
FIG. 6 is a schematic diagram illustrating a capacitor network for adding analog signals, such as the outputs of several multiplication circuits according to the present invention, in a filter circuit employing a single adder.
Figure 5:
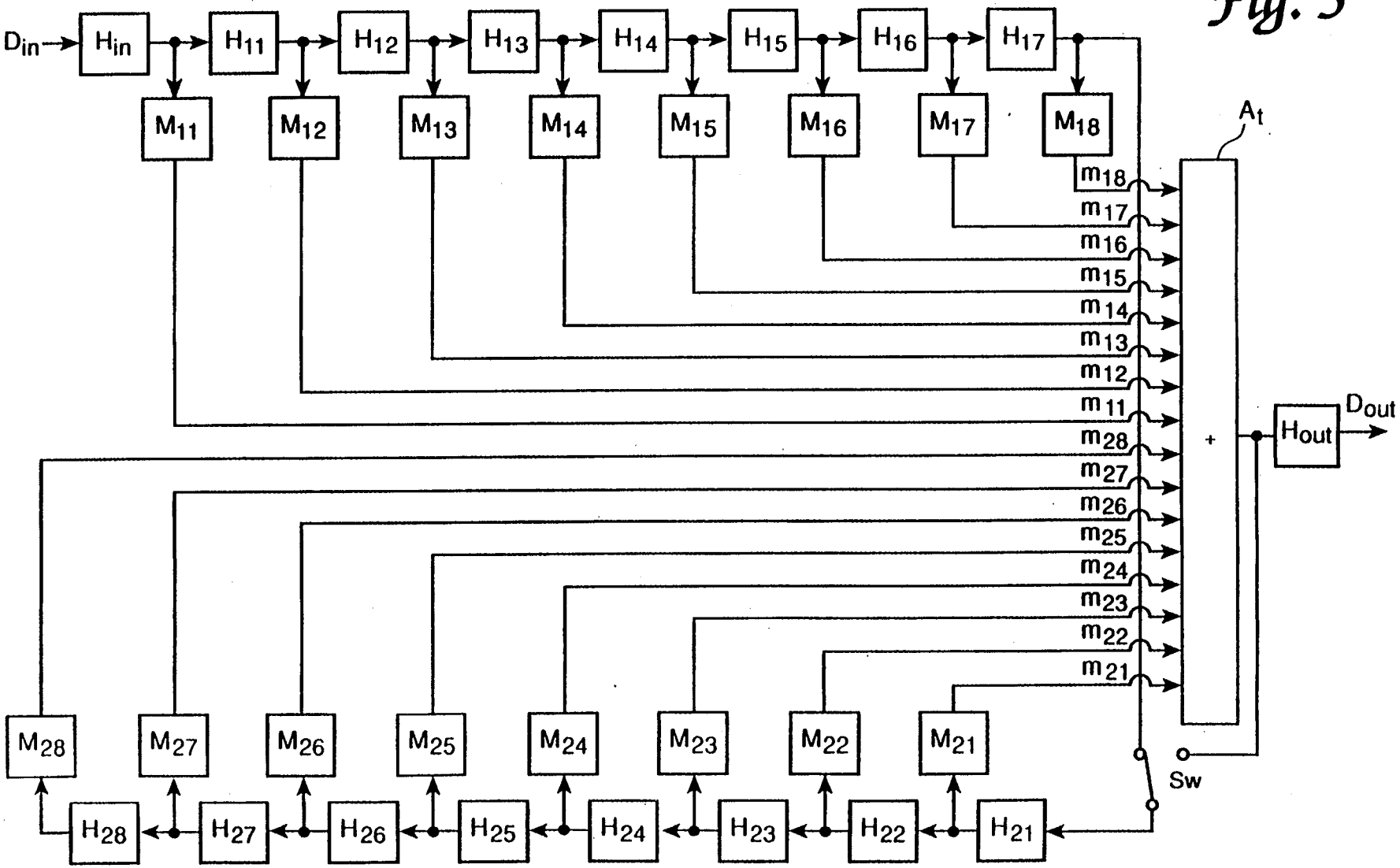
FIG. 5 is a block diagram illustrating the use of multiplication circuits according to the present invention in a filter circuit with switchable F.I.R. and I.I.R. characteristics, utilizing a single adder.

FIG. 5 illustrates a second filter circuit which uses a single adder $A_t$ rather than adders $A_{jk}$. The output of each multiplication circuit $M_{jk}$, denoted as $m_{jk}$ in FIG. 5, drives a capacitor $C_{jk}$ in a capacitor weighting network illustrated in FIG. 6. The second terminal of capacitor $C_{jk}$ is connected to a common node $V_a$. Adder $A_t$ performs a weighted addition by using the capacitor network illustrated in FIG. 6. The steps of the calculation are similar to those of the circuit in FIG. 4.

What is claimed is:

1. A multiplication circuit comprising:

i) a first operational amplifier having a non-inverting input receiving an analog input voltage;

ii) a first field-effect transistor having a drain receiving an output of said first operational amplifier;

iii) a first capacitor having a first terminal connected to a source terminal of said first field-effect transistor;

iv) a second capacitor having a first terminal connected to a second terminal of said first capacitor and an inverting input of said first operational amplifier, and a second terminal connected to ground;

v) a second operational amplifier having a non-inverting input connected to ground;

vi) a second field-effect transistor having a source connected to an output of said second operational amplifier;

vii) a third capacitor connected to said first terminal of said first capacitor, a drain of said second field-effect transistor and an inverting input of said second operational amplifier; and viii) a pair of complementary digital inputs, one being connected to a gate of said first field-effect transistor, the other being connected to a gate of said second field-effect transistor.

2. A multiplication circuit comprising:

i) a first differential amplifier having a non-inverting input receiving an analog input voltage;

ii) a first transistor having a first input receiving an output of said first differential amplifier and a control input receiving a first digital signal;

iii) a first capacitor having a first terminal coupled to an output of said first transistor and a second terminal coupled to an inverting input of said first differential amplifier;

iv) a second capacitor having a first terminal coupled to said second terminal of said first capacitor and said inverting input of said first differential amplifier, and a second terminal coupled to ground;

v) a second differential amplifier having an inverting input receiving said output of said first transistor and a non-inverting input coupled to ground;

vi) a third capacitor having a first terminal and a second terminal, said first terminal coupled to said first terminal of said first capacitor; and vii) a second transistor having a first input receiving an output of said second differential amplifier and having a control input receiving a second digital signal, said second digital signal having a logical complementary relation to said first digital signal.

3. A multiplication circuit comprising:

i) first amplifier means for producing an output signal, said first amplifier means having a first and a second input, said output signal being related to a difference between an analog signal received at said first input and a signal received at said second input;

ii) a first capacitor having a first terminal coupled to ground and a second terminal coupled to said second input of said first amplifier means;

iii) a second capacitor having a first and a second terminal, said first terminal coupled to said second terminal of said first capacitor;

iv) first switching means for providing said output signal of said first amplifier means to said second terminal of said second capacitor in response to a first digital signal received at a control input of said first switching means;

v) second amplifier means for producing an output signal, said second amplifier means having a first and a second input, said output signal being related to a difference between a ground reference received at said first input and a signal received from said second terminal of said second capacitor at said second input;

vi) second switching means for providing said output signal of said second amplifier means to said second input of said second amplifier means in response to a second digital signal received at a control input of said second switching means, said second digital signal having a logical complementary relation to said first digital signal; and vii) a third capacitor having a first and a second terminal, said first terminal coupled to said second terminal of said second capacitor.

4. A multiplication circuit comprising:

i) first amplifier means for producing an output signal, said first amplifier means having a first and a second input, said output signal being related to a difference between an analog signal received at said first input and a signal received at said second input;

ii) voltage-divider means for providing an output signal to said second input of said first amplifier means, said output signal being proportional to a signal received at an input of said voltage-divider means;

iii) first switching means for providing said output signal of said first amplifier means to said input of said voltage-divider means in response to a first digital signal received at a control input of said first switching means;

iv) second amplifier means for producing an output signal, said second amplifier means having a first and a second input, said output signal being related to a difference between a ground reference received at said first input and a signal received from said input of said voltage-divider means at said second input; and vi) second switching means for providing said output signal of said second amplifier means to said second input of said second amplifier means in response to a second digital signal received at a control input of said second switching means, said second digital signal having a logical complementary relation to said first digital signal.

5. A sample-and-hold circuit comprising:

i) a first differential amplifier having a non-inverting input receiving an analog signal;

ii) a first transistor having an input receiving an output of said first differential amplifier and a control input receiving a first digital signal;

iii) a first capacitor having a first terminal coupled to an output of said first transistor and an inverting input of said first differential amplifier, and a second terminal coupled to ground;

iv) a second differential amplifier having a non-inverting input receiving said output of said first transistor;

v) a second transistor having an input receiving an output of said second differential amplifier and a control input receiving a second digital signal, said second digital signal having a logical complementary relation to said first digital signal; and vi) a second capacitor having a first terminal coupled to an output of said second transistor and an inverting input of said second differential amplifier, and a second terminal coupled to ground.

6. A sample-and-hold circuit comprising:

i) first amplifier means for producing an output signal, said first amplifier means having a first and a second input, said output signal being related to a difference between an analog signal received at said first input and a signal received at said second input;

ii) a first capacitor having a first terminal coupled to ground and a second terminal coupled to said second input of said first amplifier means;

iii) first switching means for providing said output signal of said first amplifier means to said second terminal of said first capacitor in response to a first digital signal received at a control input of said first switching means;

iv) second amplifier means for producing an output signal, said second amplifier means having a first and a second input, said output signal being related to a difference between a signal received from said second terminal of said first capacitor means and a signal received at said second input;

v) a second capacitor having a first terminal coupled to ground and a second terminal providing a signal to said second input of said second amplifier means; and vi) second switching means for providing said output signal of said second amplifier means to said second terminal of said second capacitor in response to a second digital signal received at a control input of said second switching means, said second digital signal having a logical complementary relation to said first digital signal.

7. A filter circuit comprising:

a) a plurality of multiplication circuits, each multiplication circuit in said plurality of multiplication circuits comprising:

i) first amplifier means for producing an output signal, said first amplifier means having a first and a second input, said output signal being related to a difference between an analog signal received at said first input and a signal received at said second input;

ii) a first capacitor having a first terminal coupled to ground and a second terminal coupled to said second input of said first amplifier means;

iii) a second capacitor having a first and a second terminal, said first terminal coupled to said second terminal of said first capacitor;

iv) first switching means for providing said output signal of said first amplifier means to said second terminal of said second capacitor in response to a first digital signal received at a control input of said first switching means;

v) second amplifier means for producing an output signal, said second amplifier means having a first and a second input, said output signal being related to a difference between a ground reference received at said first input and a signal received from said second terminal of said second capacitor at said second input;

vi) second switching means for providing said output signal of said second amplifier means to said second input of said second amplifier means in response to a second digital signal received at a control input of said second switching means, said second digital signal having a logical complementary relation to said first digital signal;

vii) a third capacitor having a first and a second terminal, said first terminal coupled to said second terminal of said second capacitor; and b) a plurality of sample-and-hold circuits coupled in electrical series fashion, such that each said multiplication circuit is coupled to a corresponding sample-and-hold circuit, each said sample-and-hold circuit in said plurality of sample-and-hold circuits comprising:

i) first amplifier means for producing an output signal, said first amplifier means having a first and a second input, said output signal being related to a difference between an analog signal received at said first input and a signal received at said second input;

ii) a first capacitor having a first terminal coupled to ground and a second terminal coupled to said second input of said first amplifier means;

iii) first switching means for providing said output signal of said first amplifier means to said second terminal of said first capacitor in response to a first digital signal received at a control input of said first switching means;

iv) second amplifier means for producing an output signal, said second amplifier means having a first and a second input, said output signal being related to a difference between a signal received from said second terminal of said first capacitor means and a signal received at said second input;

v) a second capacitor having a first terminal coupled to ground and a second terminal providing a signal to said second input of said second amplifier means; and vi) second switching means for providing said output signal of said second amplifier means to said second terminal of said second capacitor in response to a second digital signal received at a control input of said second switching means, said second digital signal having a logical complementary relation to said first digital signal.

8. A filter circuit comprising:

a) a plurality of multiplication circuits, each multiplication circuit in said plurality of multiplication circuits comprising:

i) first amplifier means for producing an output signal, said first amplifier means having a first and a second input, said output signal being related to a difference between an analog signal received at said first input and a signal received at said second input;

ii) voltage-divider means for providing an output signal to said second input of said first amplifier means, said output signal being proportional to a signal received at an input of said voltage-divider means;

iii) first switching means for providing said output signal of said first amplifier means to said input of said voltage-divider means in response to a first digital signal received at a control input of said first switching means;

iv) second amplifier means for producing an output signal, said second amplifier means having a first and a second input, said output signal being related to a difference between a ground reference received at said first input and a signal received from said input of said voltage-divider means at said second input;

vi) second switching means for providing said output signal of said second amplifier means to said second input of said second amplifier means in response to a second digital signal received at a control input of said second switching means, said second digital signal having a logical complementary relation to said first digital signal; and b) a plurality of sample-and-hold circuits coupled in electrical series fashion, such that each said multiplication circuit is coupled to a corresponding sample-and-hold circuit, each said sample-and-hold circuit in said plurality of sample-and-hold circuits comprising:

i) first amplifier means for producing an output signal, said first amplifier means having a first and a second input, said output signal being related to a difference between an analog signal received at said first input and a signal received at said second input;

ii) a first capacitor having a first terminal coupled to ground and a second terminal coupled to said second input of said first amplifier means;

iii) first switching means for providing said output signal of said first amplifier means to said second terminal of said first capacitor in response to a first digital signal received at a control input of said first switching means;

iv) second amplifier means for producing an output signal, said second amplifier means having a first and a second input, said output signal being related to a difference between a signal received from said second terminal of said first capacitor means and a signal received at said second input;

v) a second capacitor having a first terminal coupled to ground and a second terminal providing a signal to said second input of said second amplifier means; and vi) second switching means for providing said output signal of said second amplifier means to said second terminal of said second capacitor in response to a second digital signal received at a control input of said second switching means, said second digital signal having a logical complementary relation to said first digital signal.

* * * * *